US006896527B1

(12) United States Patent
Peng

(10) Patent No.: US 6,896,527 B1
(45) Date of Patent: May 24, 2005

(54) SLIM USB MALE CONNECTOR WITH SYSTEM GROUNDING

(75) Inventor: Morris Peng, Tu Cheng (TW)

(73) Assignee: Megaforce Company Limited, Taipei Hsien (TW)

( * ) Notice: Subject to any disclaimer, the term of this patent is extended or adjusted under 35 U.S.C. 154(b) by 0 days.

(21) Appl. No.: 10/765,078

(22) Filed: Jan. 28, 2004

(51) Int. Cl.[7] ..... H01R 4/66
(52) U.S. Cl. ..... 439/108; 439/607
(58) Field of Search ..... 439/92, 95, 108, 439/607

(56) References Cited

U.S. PATENT DOCUMENTS 6,196,874 B1 * 3/2001 Wu ..... 439/607
2004/0038565 A1 * 2/2004 Yen ..... 439/79
2004/0087213 A1 * 5/2004 Kao ..... 439/638
2004/0102093 A1 * 5/2004 Huang ..... 439/607

* cited by examiner

*Primary Examiner*—Tho D. Ta
*Assistant Examiner*—James R. Harvey
(74) *Attorney, Agent, or Firm*—Rosenberg, Klein & Lee

(57) ABSTRACT

A slim USB male connector with system grounding mates with a USB socket. The USB male connector is received in a space between a mating board and a bottom wall of a frame of the USB socket. The USB male connector has a circuit board formed with a plurality of circuits on top and bottom surfaces thereof. Four contacts are formed on the top surface of the circuit board and connected with the circuits thereon. A grounding plate is mounted on the bottom surface of the circuit board and connected with a grounding circuit on the circuit board. The grounding plate connects to the tongues of the USB socket to ground the system.

9 Claims, 8 Drawing Sheets

SLIM USB MALE CONNECTOR WITH SYSTEM GROUNDING

BACKGROUND OF THE INVENTION

1. Field of the Invention

The present invention relates to a slim USB male connector with system grounding, and particularly to a slim USB male connector complying with A-type USB specifications with a hidden grounding portion for achieving system grounding 2. Description of the Prior Art The Universal Serial Bus (USB) is an astonishingly useful way to connect large numbers of peripherals together. It is becoming increasingly important in today's electronics world. One of the reasons that USB was implemented was to replace existing serial and parallel ports on computers. USB has several advantages for this application.

First, it uses a much higher data transfer rate than many common serial data formats.

Second, it allows a large number of devices to be attached to a single host USB connector. Up to 127 devices can theoretically be used on a single USB port.

Third, it simplifies the connection to external devices. USB supports "plug and play" where the operator does not need to be heavily involved in the set-up process. When a device is connected to a host's USB bus, it is immediately recognized by the host, dynamically enumerated, and assigned an address by the host.

Reference is made to FIG. 1, which is a perspective view of A-type USB socket (a female connector) and an USB connector (a male connector). The A-type USB socket 70 and USB connector 90 follow A-type physical specifications for achieving electrical connection. The USB socket 70 is usually mounted on a PCB 80 of the host (not shown) grounded with the computer system. The USB socket 70 has a frame 72 and a mating board 76 mounted in the frame 72. The frame 72 is formed by stamping a metal board and formed with a plurality of elastic tongues 74 on a periphery of the frame 72. The mating board 76 is formed with an insulative material and mounted with four contacts 78. A receiving space 79 is formed between the mating board 76 and the frame 72. The USB connector 90 uses a four-wire cable interface 91. Two of the wires are used in a differential mode for both transmitting and receiving data, and the remaining two wires are power and ground. The source of the power to a USB device can come from the host or a hub. The USB connector 90 has a housing 92 made by stamping and formed with four cutouts 94 thereon, and a mating board 96 that is mounted in the housing 92 and disposed with four terminals 98 on an upper surface thereof. The housing 92 complies with USB-IF grounding requirements by grounding with the computers via the USB socket 70. When the USB connector 90 is inserted into the USB socket 70, the tongues 74 of the frame 72 of the USB socket 70 are clipped and wedged in the cutouts 94 of the housing 92. The four terminals 98 of the mating board 96 are respectively electrically connected with the contacts 78 of the mating board 76.

However, the metal housing 92 limits the size of the USB connector 90. When inserting the USB connector 90 into a stacked USB socket, it is crowded by the neighboring USB connector and is inconvenient. The slim design of the USB connector 90 is restricted by the housing 92 and the housing 92 becomes an obstacle to slim design.

Hence, an improved slim USB male connector is required to overcome the disadvantages of the prior art.

SUMMARY OF THE INVENTION

The main object of the present invention is to provide a slim USB male connector with system grounding, and particularly to a USB male connector having a compact contour without the metal housing and complying with A-type USB specifications with a hidden grounding portion for achieving system grounding.

In order to achieve the above objects, the present invention provides a slim USB male connector with system grounding that is mated with a USB socket. The USB socket has a frame stamped with a plurality of tongues, a mating board mounted in the frame, and four terminals mounted on a bottom of the mating board. The USB male connector is received in a space between the mating board and a bottom wall of the frame. The USB male connector comprises a circuit board formed with a plurality of circuits on top and bottom surfaces thereof. Four contacts are formed on the top surface of the circuit board and connected with the circuits thereon. A grounding plate is mounted on the bottom surface of the circuit board and connected with a grounding circuit on the circuit board. The grounding plate is connected to the tongues of the USB socket for achieving system grounding.

Other objects, advantages and novel features of the present invention will become more apparent from the following detailed description of the present embodiment when taken in conjunction with the accompanying drawings.

BRIEF DESCRIPTION OF THE DRAWINGS

The foregoing aspects and many of the attendant advantages of this invention will be more readily appreciated as the same becomes better understood by reference to the following detailed description, when taken in conjunction with the accompanying drawings, wherein.

DESCRIPTION OF THE PREFERRED EMBODIMENT

Figure 1:
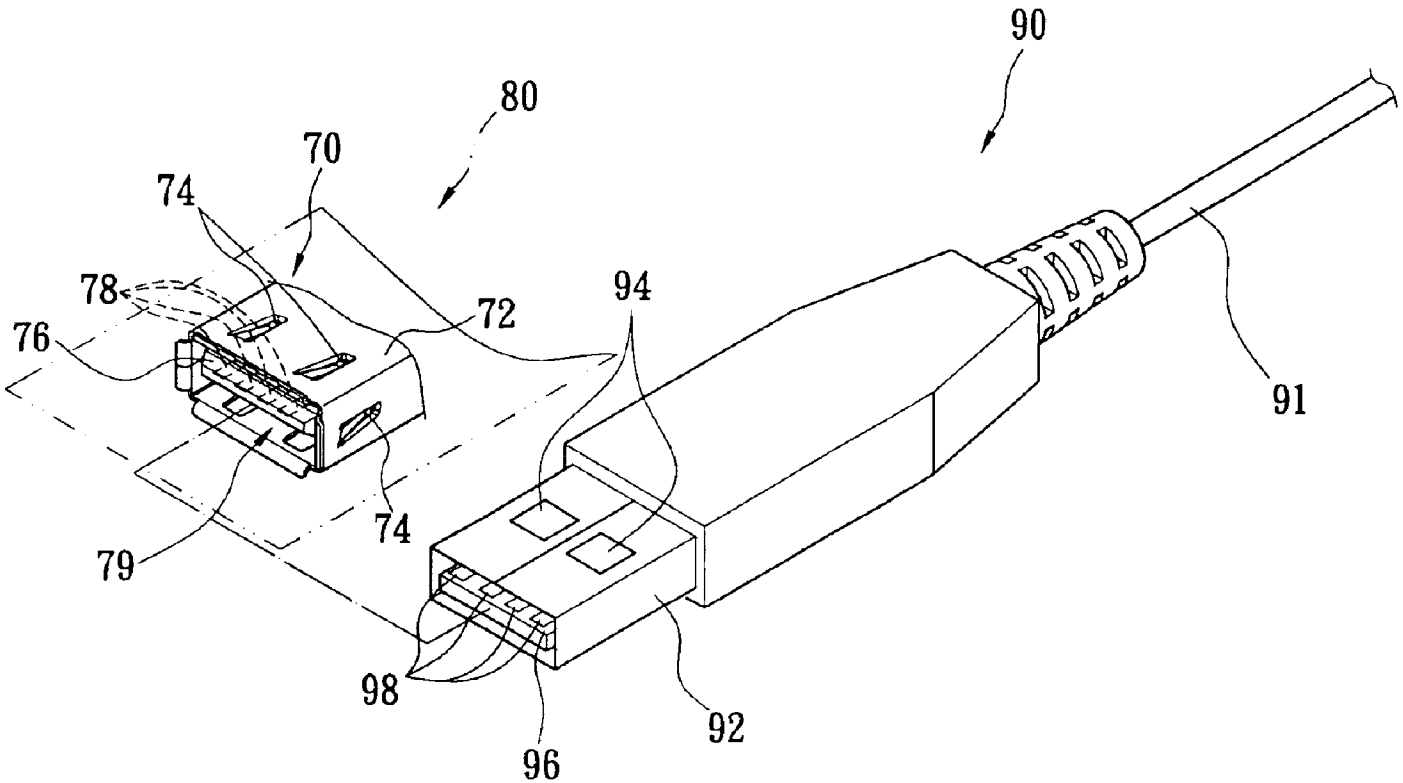
FIG. 1 PRIOR ART
FIG. 1 is a perspective view of A-type USB socket and an USB connector.
Figure 2:
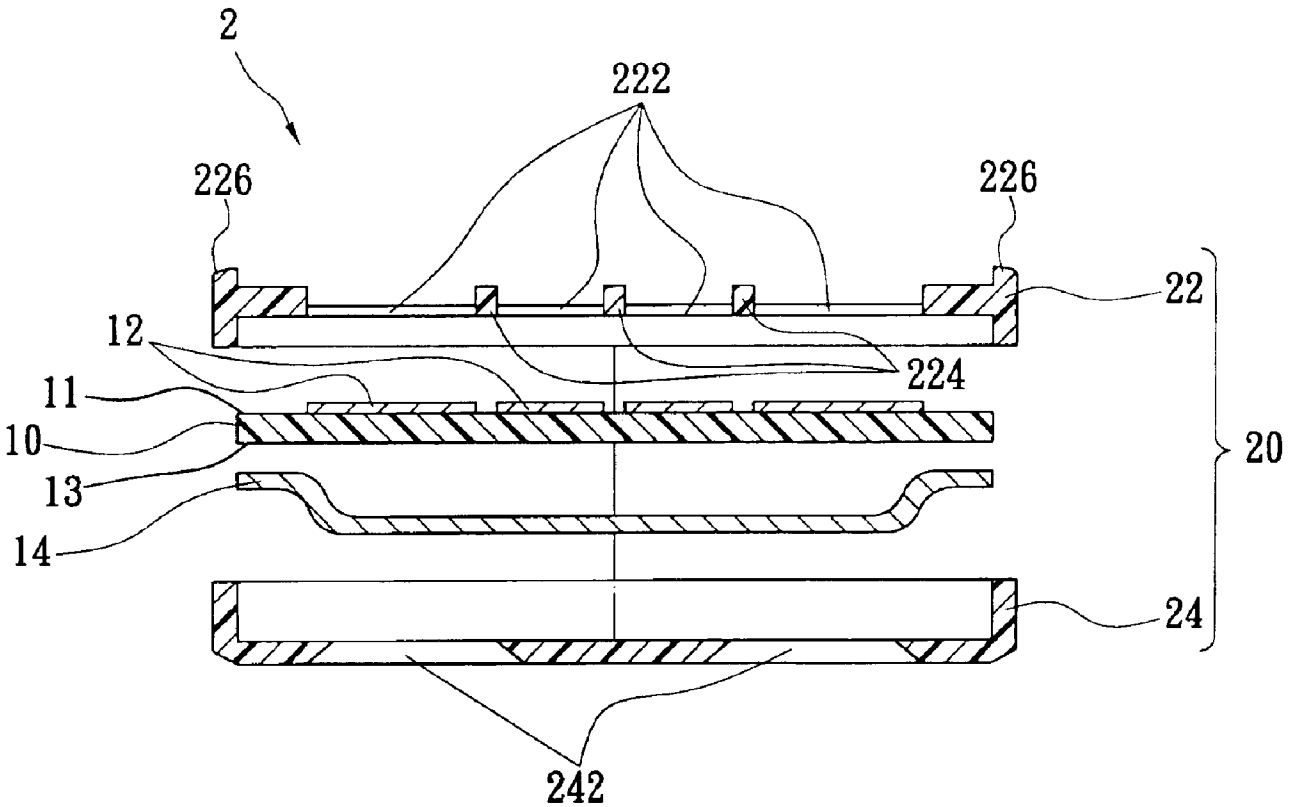
FIG. 2 is an exploded cross-sectional view of a slim USB male connector with system grounding according to the present invention.

Reference is made to FIG. 2, which is an exploded cross-sectional view of a slim USB male connector with system grounding according to the present invention. The slim USB male connector 2 is mated with the USB socket 70 of the prior art. The USB socket 70 as mentioned above, has a frame 72 stamped with a plurality of elastic tongues 74, a mating board 76 mounted in the frame 72, and four terminals 76 mounted on a bottom of the mating board 76. A space 79 is formed between the mating board 76 and a bottom wall of the frame 72.

The USB male connector 2 is received in the space 79 of the USB socket 70. The USB male connector 2 comprises a circuit board 10, four contacts 12, and a grounding board 14.

The circuit board 10 is formed with a plurality of circuits (not shown) on a top surface 11 and a bottom surface 13 thereof.

The four contacts 12 are made of conductive metal, and mounted on the top surface 11 of the circuit board 10 and connected with the corresponding circuits thereon. The size of the four contacts 12 complies with the four contacts 78 of the USB socket 70, both physically and electrically. The four contacts 12 are contiguously in contact with the contacts 78 of the USB socket 70.

The grounding plate 14 is formed by stamping a metal board. The grounding plate 14 has two ends respectively soldered on the bottom 13 of the circuit board 10 and connected with a grounding circuit thereon. The grounding plate 14 is connected to the tongues 74 of the USB socket 70 for achieving system grounding.

An insulative housing 20 covers a periphery of the circuit board 10. The insulative housing 20 has an upper housing 22 and a lower housing 24 respectively formed with grooves 222, 242 for exposing the contacts 12 and the grounding plate 14 outside. The upper housing 22 has four upper grooves 222, and protruding walls 224, 226 respectively protruding from two side edges thereof and between the upper grooves 22. The protruding walls 226 are respectively inserted into side gaps between the mating board 76 and two sides of the frame 72 of the USB socket 70.

The lower housing 24 of the insulative housing 20 has a pair of grounding grooves 242 for exposing the grounding plate 14 outside and receiving the tongues 74 of the frame 72 of the USB socket 70 therein. The grounding plate 14 is electrically connected to the tongues 74 with a fixing function.

Figure 3:
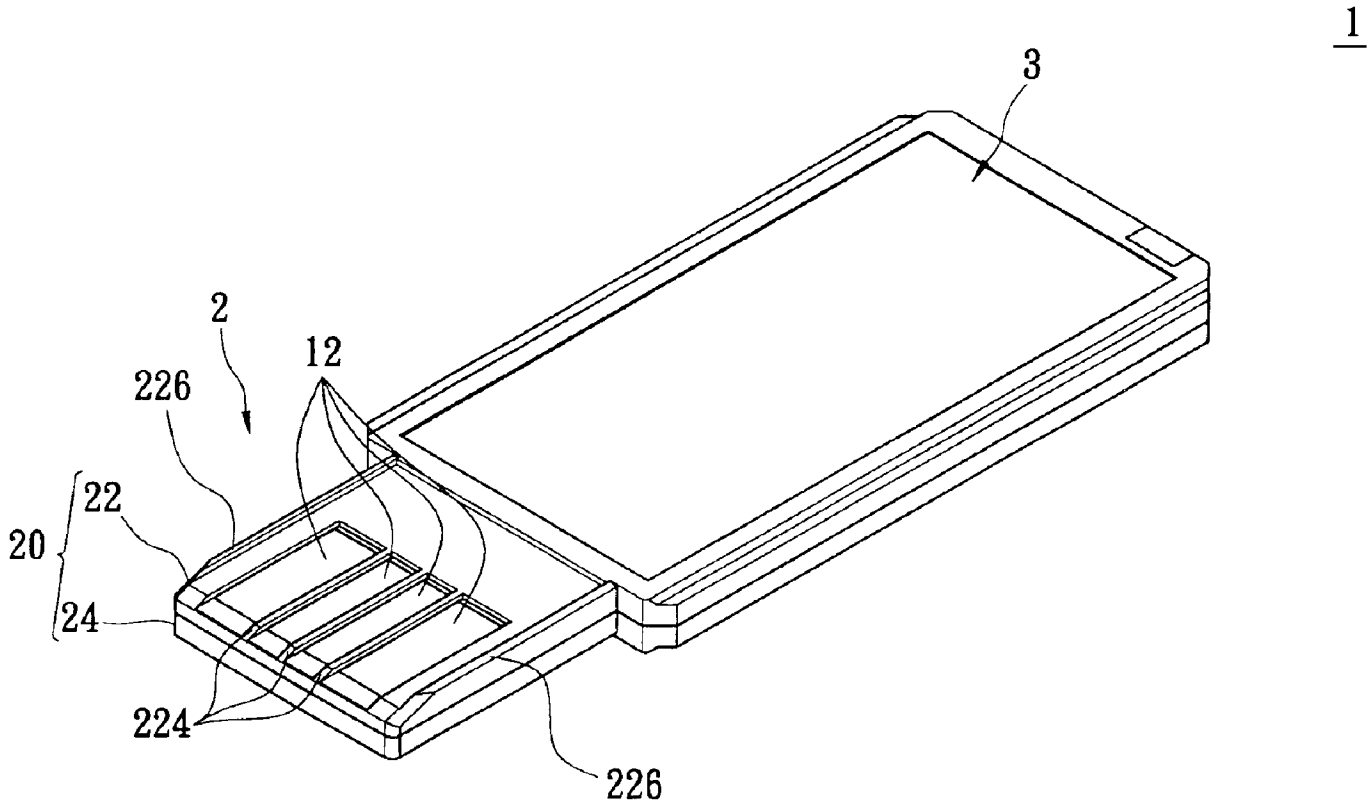
FIG. 3 is a perspective view of the slim USB male connector applied in a storage device from different views.
Figure 3A:
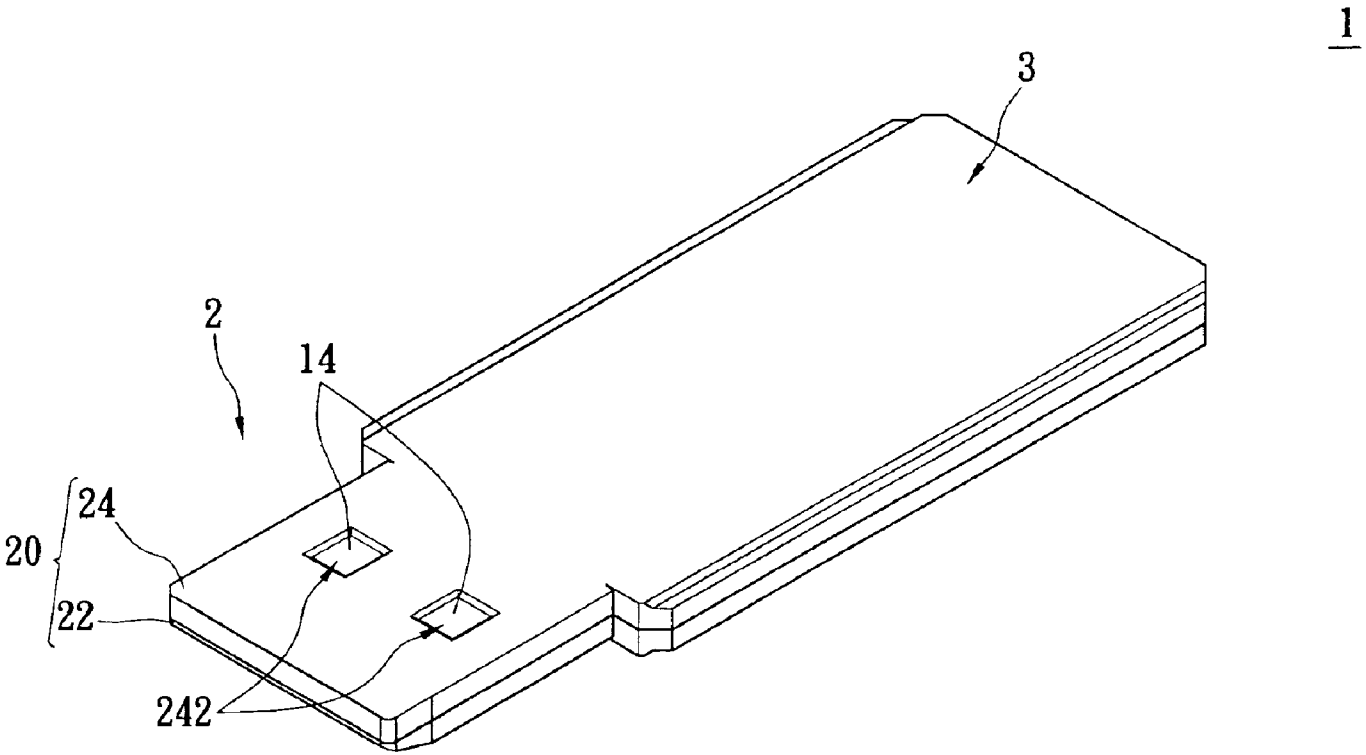
FIG. 3A is a perspective view of the slim USB male connector applied in a storage device from a different view.

Reference is made to FIG. 3 and FIG. 3A, which are perspective views of the slim USB male connector applied in a storage device from different views. The slim USB male connector 2 can be applied in different electrical devices with advantages of compact and convenient carrying. The slim USB male connector with system grounding 2 further comprises a storage device 3 extending from an end of the circuit board 10 and forming a flash memory card 1. The flash memory card 1 is more compact and slimmer due to the slim USB male connector 2. A plugging portion of the flash memory card 1 is as thin as the storage device 3, which is beneficial when applied in an electrical device such as, for example, a PDA, digital camera or notebook. A circuit layout of the storage device 3 is not the character of the present invention, and so is not mentioned here.

Figure 4:
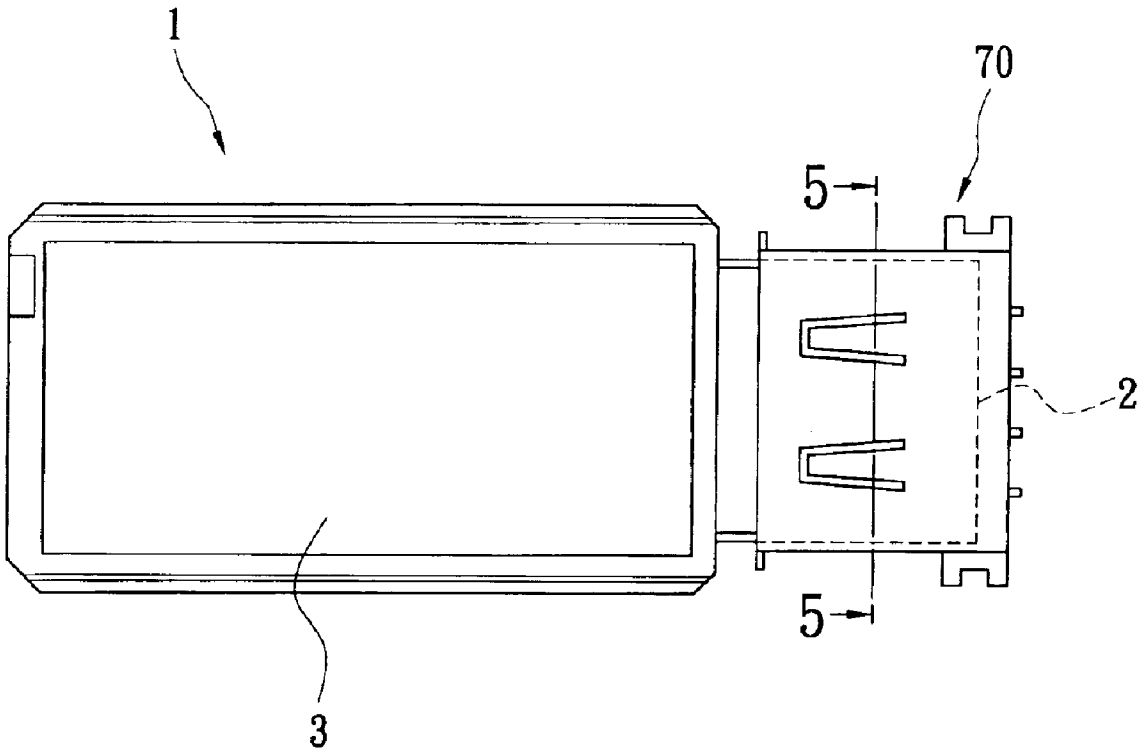
FIG. 4 is a top view of a flash memory card with the present invention plugged in a USB socket.
Figure 5:
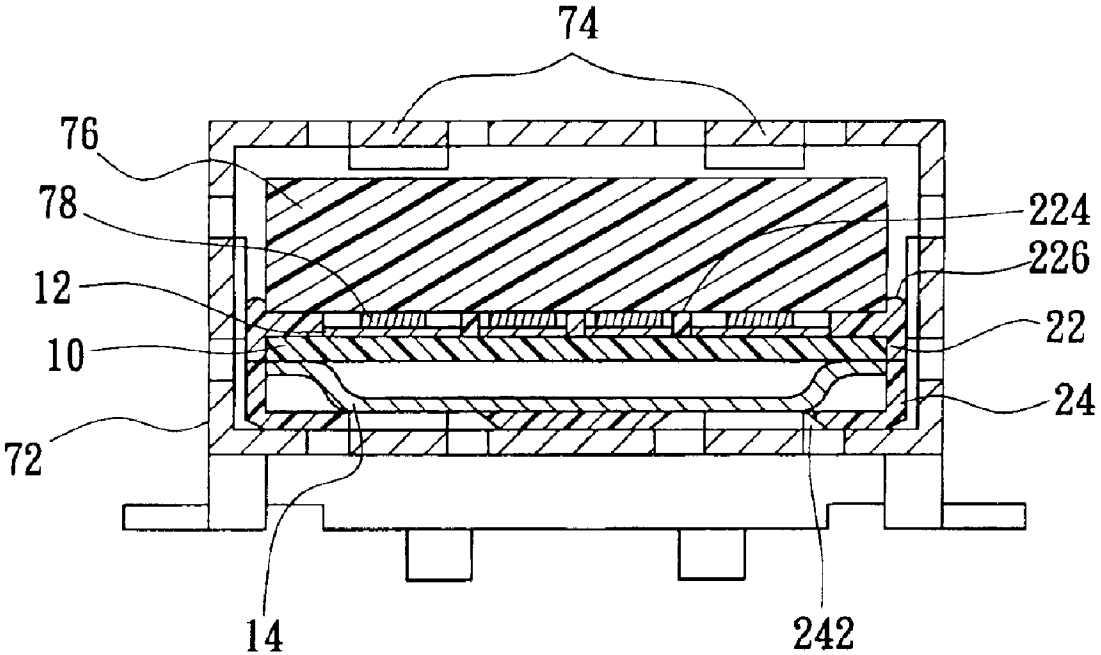
FIG. 5 is a cross-sectional view along line 5—5 in FIG. 4.

Referring to FIG. 4 and FIG. 5, FIG. 4 is a top view of a flash memory card with the present invention plugged in an USB socket, and FIG. 5 is a cross-sectional view along line 5—5 in the FIG. 4. A particularly distinguishing feature of the slim male connector 2 of the present invention is that the slim male connector 2 abandons the frame of prior art and replaces the same with an insulative housing 20 of non-metal material. The contacts 12 and the grounding plate 14 are hidden in the insulative housing 20. The slim male connector 2 is only inserted in the lower space 79 of the USB socket 70. The slim male connector 2 entirely complies with the specifications and functions of USB and has a hidden grounding design for system grounding. The total height of the slim male connector 2 of the present invention is about half of the USB connector of the prior art, and the width thereof is reduced as well. The advantages of compact of the present invention are especially manifest when applied in the flash memory.

Figure 6:
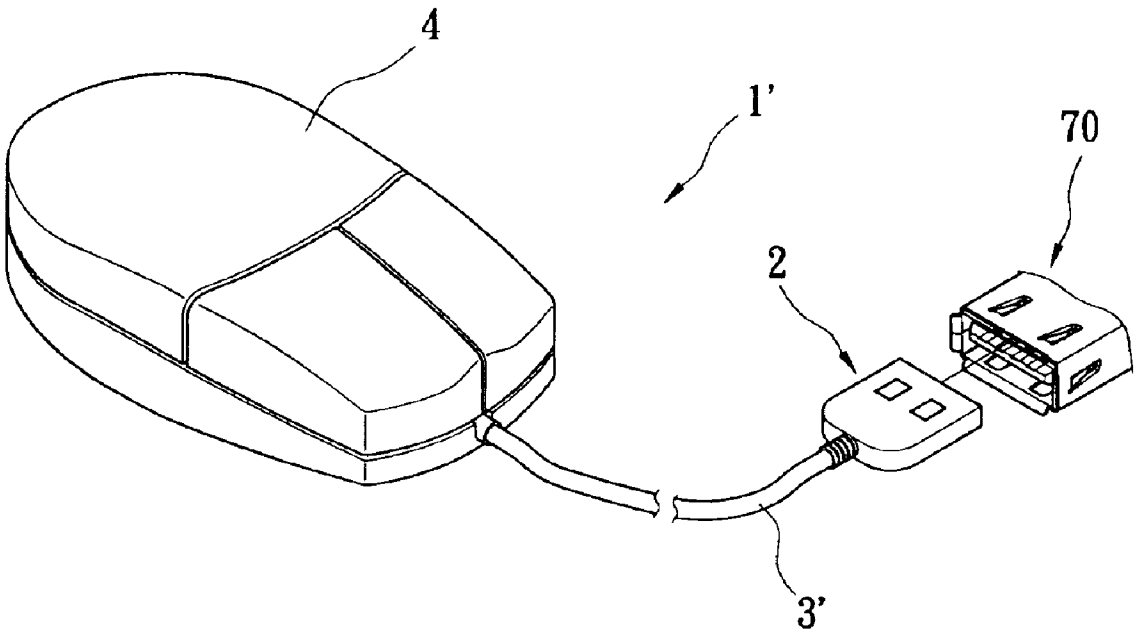
FIG. 6 is a side view of the slim USB male connector applied in a computer peripheral device.
Figure 7:
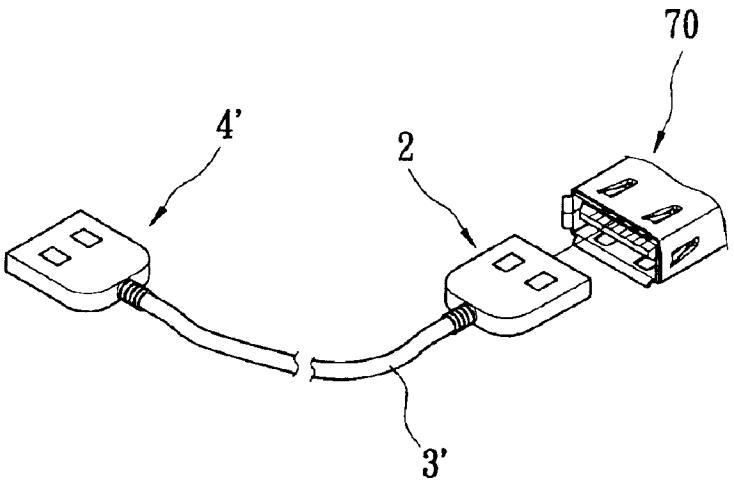
FIG. 7 is a perspective view of a connecting cable combined with the present invention.

Reference is made to FIG. 6, which is a side view of the slim USB male connector applied in computer peripheral device. The slim male connector 2 of the present invention further comprises a cable 3' connecting with an end of the circuit board 10 and electrically connecting with the circuits of the circuit board 10. The cable 3' can be connected with a computer peripheral 4 such as, for example, a mouse or keyboard. Conversely, the cable 3' can be connected with an electrical connector 4' and form a connecting cable (as shown in FIG. 7) for transferring data between electric devices.

It is to be understood, however, that even though numerous characteristics and advantages of the present invention have been set forth in the foregoing description, together with details of the structure and function of the invention, the disclosure is illustrate only, and changes may be made in detail, especially in matters of shape, size, and arrangement of parts within the principles of the invention to the full extent indicated by the broad general meaning of the terms in which the appended claims are expressed.

What is claimed is:

1. A slim USB male connector with system grounding, mating with a USB socket, the USB socket having a frame stamped with a plurality of tongues, a mating board mounted in the frame, and four terminals mounted on a bottom of the mating board, wherein the USB male connector is received in a space between the mating board and a bottom wall of the frame, the slim USB male connector comprising:

a circuit board formed with a plurality of circuits on top and bottom surfaces thereof;

four contacts formed on the top surface of the circuit board and connected with the circuits thereon; and a grounding plate mounted on the bottom surface of the circuit board and connected with a grounding circuit thereon, wherein the grounding plate connects with the tongues of the USB socket for achieving system grounding.

2. The slim USB male connector with system grounding as claimed in claim 1, further comprising a storage device extending from an end of the circuit board and forming a flash memory card.

3. The slim USB male connector with system grounding as claimed in claim 1, further comprising a cable connecting with an end of the circuit board and electrically connecting with the circuits of the USB male connector.

4. The slim USB male connector with system grounding as claimed in claim 3, wherein the cable is connected to a computer peripheral device.

5. The slim USB male connector with system grounding as claimed in claim 3, wherein the cable is connected to an electrical connector and forms an connecting cable for transferring data between electric devices.

6. The slim USB male connector with system grounding as claimed in claim 1, wherein the grounding plate is formed by stamping a metal board and has two ends respectively soldered on a bottom of the circuit board.

7. The slim USB male connector with system grounding as claimed in claim 1, wherein the circuit board further comprises an insulative housing covered around a periphery of the circuit board, and wherein the insulative housing is formed with grooves for exposing the contacts and the grounding plate outside.

8. The slim USB male connector with system grounding as claimed in claim 7, wherein the insulative housing has a pair of grounding grooves for exposing the grounding plate and receiving the tongues of the frame of the USB socket therein.

9. The slim USB male connector with system grounding as claimed in claim 7, wherein the insulative housing has a pair of protruding walls respectively protruding from two side edges thereof and respectively inserting into side gaps between the mating board and two sides of the frame of the USB socket.

* * * * *